US007004406B2

(12) United States Patent
Yang et al.

(10) Patent No.: US 7,004,406 B2
(45) Date of Patent: Feb. 28, 2006

(54) ENHANCED NEEDLE MOTION CONTROLLER

(75) Inventors: Xilin Yang, Streamwood, IL (US); Ning Lei, Oak Brook, IL (US); Puning Wei, Lisle, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 606 days.

(21) Appl. No.: 10/242,472

(22) Filed: Sep. 12, 2002

(65) Prior Publication Data

US 2004/0050973 A1 Mar. 18, 2004

(51) Int. Cl.

| | |
|---|---|
| ***F02M 61/20*** | (2006.01) |
| ***F02M 59/00*** | (2006.01) |
| ***F02M 61/00*** | (2006.01) |
| ***B05B 1/30*** | (2006.01) |

(52) U.S. Cl. ..... 239/533.9; 239/585.5; 239/533.2; 239/533.8; 239/585.1; 239/533.12; 239/88

(58) Field of Classification Search ..... 239/533.9, 239/533.2, 533.12, 88–93, 585.1, 585.3, 239/585.4, 585.5, 533.1, 533.8; 251/129.15, 251/129.21, 127

See application file for complete search history.

(56) References Cited

U.S. PATENT DOCUMENTS

| | | | | |
|---|---|---|---|---|
| 2,374,614 | A | | 4/1945 | Nichols |
| 4,349,152 | A | * | 9/1982 | Akagi ..... 239/96 |
| 5,397,055 | A | * | 3/1995 | Paul et al. ..... 239/124 |
| 5,429,309 | A | | 7/1995 | Stockner |
| 5,460,329 | A | | 10/1995 | Sturman |
| 5,697,342 | A | | 12/1997 | Anderson et al. |
| 5,752,659 | A | | 5/1998 | Moncelle |
| 5,779,149 | A | * | 7/1998 | Hayes, Jr. ..... 239/124 |
| 6,119,962 | A | | 9/2000 | Youakim et al. |

* cited by examiner

*Primary Examiner*—Davis Hwu
(74) *Attorney, Agent, or Firm*—Dennis Kelly Sullivan; Susan L. Lukasik; Jeffrey P. Calfa

(57) ABSTRACT

A controller for controlling a needle valve of a spring closing type fuel injector includes a fluid assist selectively exerting a force on the needle valve, the force acting in cooperation with a bias exerted by a return spring on the needle valve to effect a relatively low valve opening pressure of the needle valve and relatively very high valve closing pressure. A spring closing type fuel injector and a method for controlling a needle valve of a spring closing type fuel injector are further included.

30 Claims, 6 Drawing Sheets

ENHANCED NEEDLE MOTION CONTROLLER

TECHNICAL FIELD

The present invention relates to fuel injectors. More particularly, the present invention relates to spring closing needle type fuel injectors.

BACKGROUND OF THE INVENTION

An exemplary base line injector is depicted at 10 in prior art FIG. 1. Reference may be had to U.S. Pat. No. 5,460,329, incorporated herein by reference, for additional detail on injector 10. The injector 10 has a housing 12 that is disposable in a receiver defined in an engine head. An injector module 14 is disposed within an aperture defined in the housing 12.

The principal operating components of the prior art injector 10 include the control valve assembly 16, intensifier assembly 18, and needle valve assembly 20.

The control valve assembly 16 includes a translatable spool 22 that is transversely translatable under the influence of at least one solenoid 24. It is understood that while two solenoids 24 are depicted, one of the solenoids 24 could be replaced by a return spring or other biasing element.

The spool 22 is selectively in fluid communication with an actuating fluid inlet 0.26 and an actuating fluid vent 28. The spool 22 is further in fluid communication with an actuating fluid passageway 30. The actuating fluid that is preferably utilized with the injector 10 is engine lubricating oil at elevated pressures of generally 450–3,000 psi. It is understood that other suitable actuating fluids could be used as well, including without limitation, engine fuel.

The intensifier assembly 18 includes a translatable piston 32 and a depending plunger 34. In practice, the piston 32 and plunger 34 are formed integral as a single component.

The piston 32 has a piston head 36 that has a selected area. The piston head 36 resides in and defines in part an actuation chamber 38. The actuation chamber 38 is in fluid communication with the actuation fluid passageway 30. Fluid pressure in the actuation chamber 38 generates a downward directed force on the piston head 36. An intensifier return spring 40 bears on the underside of the piston 36 and exerts a bias on the piston 32 in opposition to any force generated by fluid pressure acting on the piston head 36.

The plunger 34 includes a plunger head 42 having a selected area. The plunger head 42 is translatably disposed in a plunger chamber 44. A checked fuel refill 46 is selectively in fluid communication with a fuel gallery and with the plunger chamber 44 for providing a volume of fuel to the injector 10 to be injected into the combustion chamber.

A high pressure fuel passage 48 is in fluid communication with the plunger chamber 44. The high pressure fuel passage 48 effects a fluid communication between the plunger chamber 44 and the needle valve assembly 20.

The needle valve assembly 20 includes a needle valve 50 and a needle valve return spring 52.

A portion of the needle valve 50 is disposed in an annular fuel passage commonly referred to as a kidney 54. The kidney 54 is in fluid communication with the high pressure fuel passage 48. A circumferential opening surface 56 is defined on the needle valve 50 and resides in the kidney 54. A depending circumferential fuel passage 58 fluidly connects the kidney 54 to injection orifice(s) 60 defined in the housing 12. The orifice 60 is in fluid communication with a combustion chamber serviced by the injector 10. The pointed tip 61 of the needle valve 50 acts to selectively open and close the orifice(s) 60.

A translatable spring seat 62 bears on the upper margin of the needle valve 50 and transmits a closing bias exerted by the needle valve return spring 52 on the needle valve. In a preferred embodiment, the spring seat 62 is formed as a component separate and distinct from the needle valve 50.

The spring seat 62 has an upper margin 64 and a lower margin 65, the lower margin 65 bearing on the upper margin of the needle valve 50. A shoulder 66 is disposed between the upper and lower margins 64, 65 and provides a seat for the return spring 52. The spring seat 62 is translatably disposed within a spring cage 68 that is defined in the injector module 14. The spring cage 68 is vented to ambient by vent 70. The fuel being vented from the spring cage 68 by vent 70 flows to ambient in the annular space defined between the housing 12 and the injector module 14.

In operation at initiation of an injection event, the spool 22 is shifted responsive to an actuation command directed to a solenoid 24. The spool 22 is shifted from a closed, venting disposition to an actuation disposition. In the actuation disposition, the spool 22 fluidly connects actuation fluid inlet 26 to the actuation fluid passageway 30. Actuation fluid floods the actuation chamber 38 and generates a significant downward force on the piston head 36. This force overcomes the bias exerted by the intensifier return spring 40 and the piston 32 and plunger 34 commence to stroke downward.

The downward stroke of the plunger 34 acts to compress the volume of fuel residing in the plunger chamber 44 and the high pressure fuel passage 48. The ratio of areas of the piston head 36 to the plunger head 42 determines the amount of compression of the volume of fuel residing in the plunger chamber 44. In practice, the fuel pressure is raised from near ambient (about 50 psi) to an injectable pressure that may be as high as 20,000 psi.

The injectable pressure of the fuel is transmitted via the high pressure fuel passage 48 to the kidney 54. The injectable pressure fuel acts upward on the opening surface 56 and on the surface of the tip 61 in opposition to the bias exerted by the needle valve return spring 52. The force generated on the opening surface 56 and on the tip 61 acts to shift the needle valve 50 upward, withdrawing the tip 61 from the orifices 60 and thereby effecting injection of fuel via the orifices 60 into the combustion chamber.

The end of injection is signaled by a further command to the solenoid 24 that effects a shifting of the spool 22 from the actuation disposition to the vent disposition.

In the vent disposition, the spool 22 fluidly couples the actuating fluid passageway 30 to the vent 28. This results in the actuation fluid in the actuation chamber 38 venting to ambient via the vent 28. With the removal of pressure in the actuation chamber 38, the intensifier return spring 40 acts upward on the piston 32 and plunger 34, returning the piston 32 and plunger 34 to the initial disposition.

Fuel pressure in the plunger chamber 44 drops dramatically with the upward motion of the plunger 34. Fuel pressure acting on the opening surface 56 and on tip 61 decays to the point where the needle valve return spring 52 is able to shift the needle 50 downward and the top 61 closes off the orifices 60, thereby ending the injection event. With the decay of pressure in plunger chamber 44, the checked fuel refill 46 opens and the plunger chamber 44 is refilled with fuel from the fuel gallery in readiness for the next injection event.

Spring closing needle type fuel injectors, such as prior art injector 10, rely on venting of the actuation chamber 38 by the spool 22 (the fuel pressure decay process) and subsequent return actuation of the piston 32 and plunger 34 by the intensifier return spring 40 to end the injection process. The needle valve 50 is then closed solely by the needle valve return spring 52.

It is desirable to minimize the emission of noxious combustion by products to have the most rapid end of injection that is possible. In conventional spring closing needle design as described above. With reference to injector 10, in order to have a faster end of injection, the design is constrained to either use a heavier needle valve return spring 52 or to improve the fuel pressure decay process. The fuel pressure decay process generally is limited by the response of the spool 22 of the control valve assembly 16. A disadvantage of utilizing a heavier needle valve return spring 52 is that the needle valve 50 then is constrained to open only at a much higher injector pressure level (VOP level) necessary to overcome the bias exerted by the increased spring force of the needle valve return spring 52. A higher VOP normally carries with it a significant penalty on engine noise emissions, especially at idle conditions. Such noise is the noise emitted by a combustion ignition engine at idle operating condition and is found to be very objectionable by the consuming public.

There is a need in the industry to improve the end of injection process. Any proposed improvement to the end of injection process should also be cognizant of effecting needle valve opening at the lowest possible fuel pressure in order to improve engine idle noise emissions.

SUMMARY OF THE INVENTION

The controller of the present invention improves the end of injection process by assisting the needle valve closing through the use of high pressure fuel, without using any electronic control means to effect such assistance. At the same time, the controller of the present invention permits the needle valve to open at much lower fuel pressure, thereby improving the engine idle noise emissions. The controller of the present invention may utilized with all spring closing needle type fuel injectors and is not limited to use with the prior art exemplary base line injector 10.

DETAILED DESCRIPTION OF THE INVENTION

Figure 1:
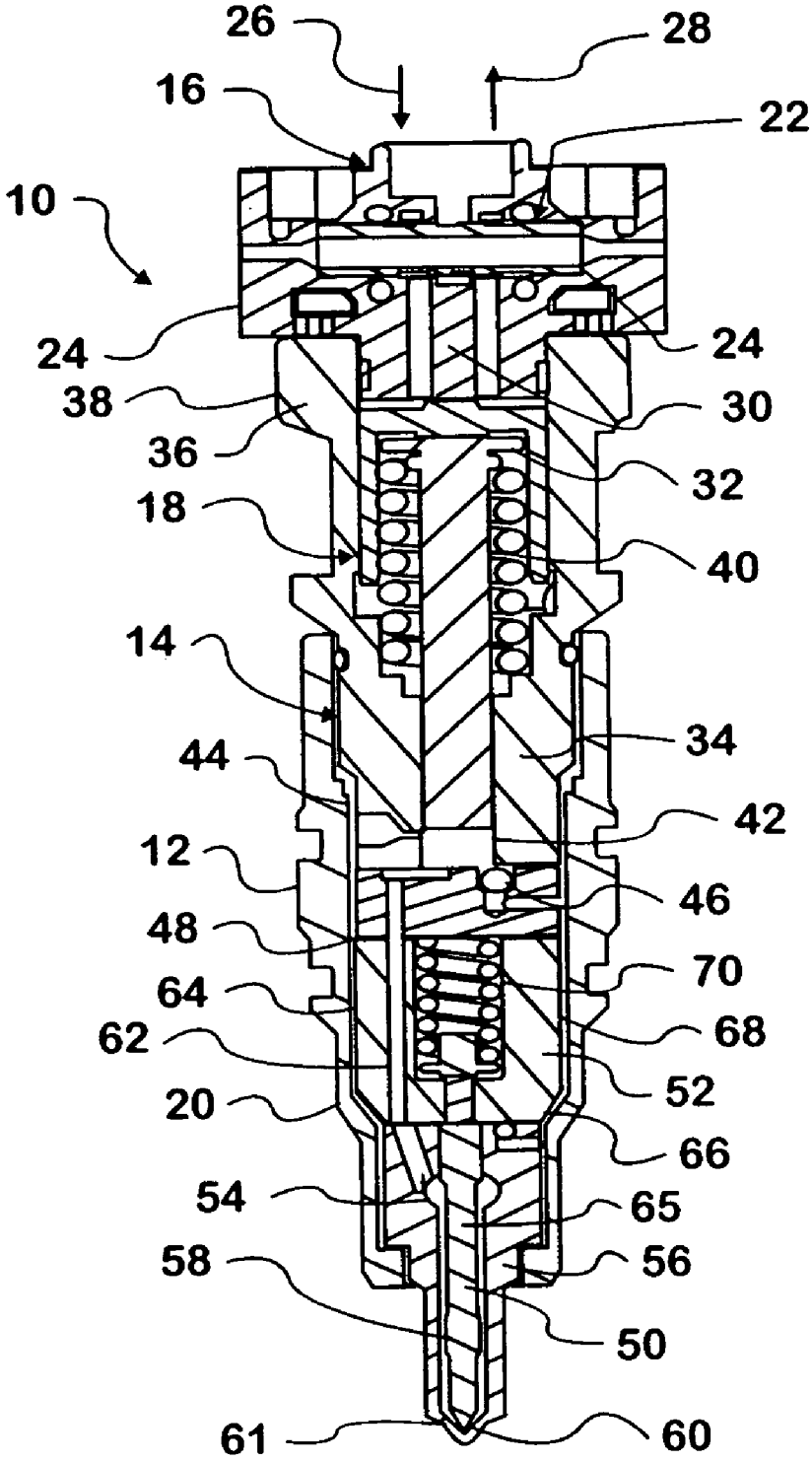
PRIOR ART FIG. 1
FIG. 1 is a sectional view of a prior art exemplary base line fuel injector.

The controller of the present inventions is shown generally at 100 in the figures. All the depictions of the embodiment of the controller 100 are disposed in a needle valve assembly 20 that is a component of a spring closing needle type fuel injector. The prior art injector 10 may be readily modified to incorporate the controller 100. Components of the needle valve assembly 20 that are common with the prior art injector 10 have the same reference numerals as utilized above in the description of the prior injector 10.

Figure 2:
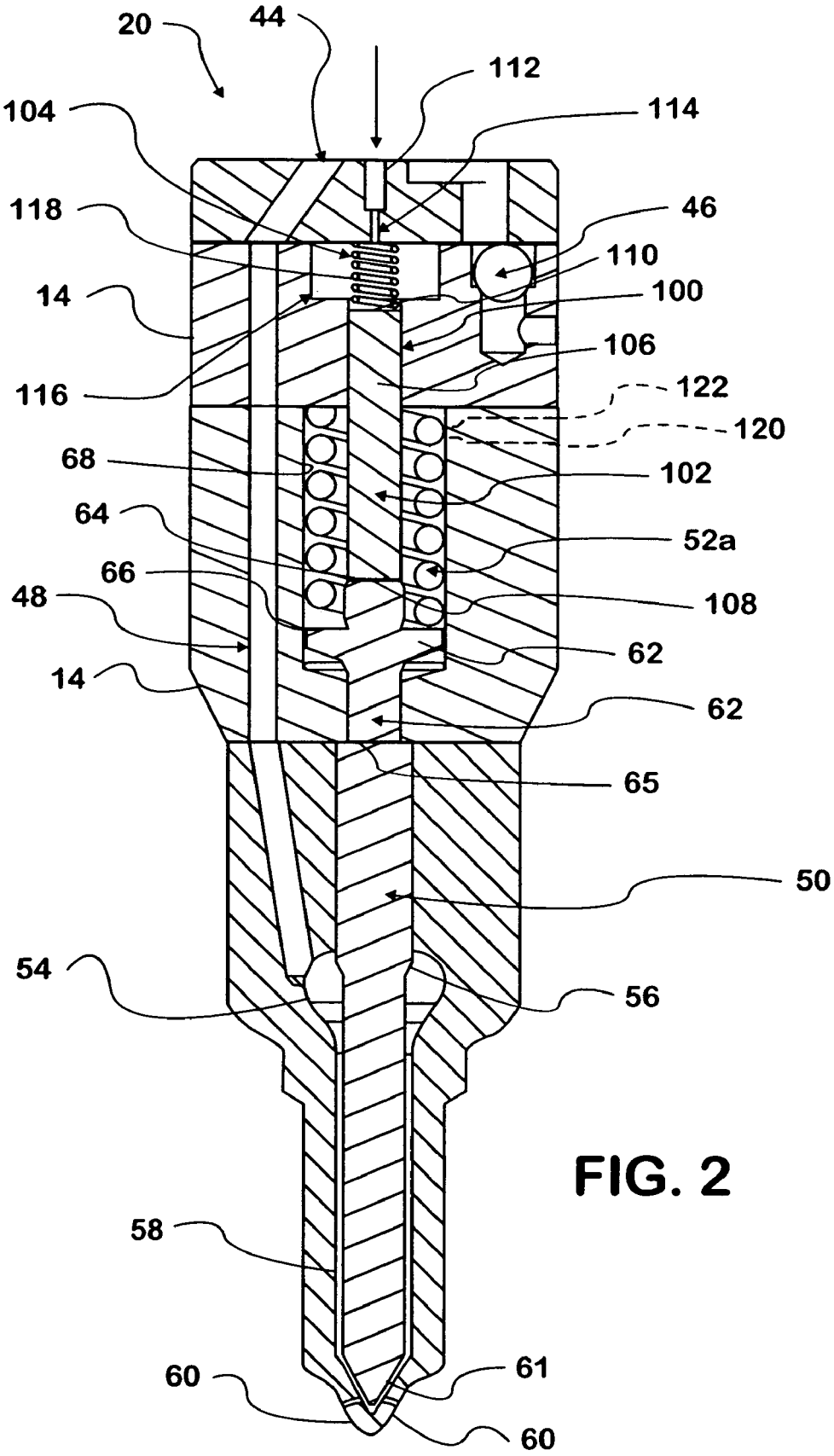
FIG. 2 is a sectional view of the needle valve assembly of a fuel injector incorporating the controller of the present invention.

Referring to the embodiment of FIG. 2, the controller 100 includes a closing pin 102 and an actuation assembly 104.

The closing pin 102 is translatably borne in a bore defined in the injector module 14. The closing pin 102 has an elongate, preferably cylindrical, pin body 106. A first end margin of the pin body 106 comprises a bearing head 108. The bearing head 108 is preferably in physical contact with the upper margin 64 of the spring seat 62. The opposed second end margin of the pin body 106 comprises a pressure head 110. The pressure head 110 has a selected area such that a known force may be generated on the pressure head 110 by a fluid pressure acting thereon.

An inlet 112 is in fluid communication with the plunger chamber 44. A closing pin feed orifice 114 fluidly communicates the inlet 112 with a pressure chamber 116 to control pressure in the pressure chamber 116. The pressure chamber 116 is variable in volume, being formed in part by the translatable pressure head 110 of the closing pin 102.

An optional biasing spring 118 may be disposed in the pressure chamber 116. The biasing spring 118 is preferably compressed in a preloaded condition between the upper margin of the pressure chamber 116 and the pressure head 110 of the closing pin 102. As such, the biasing spring 118 exerts a bias on the closing pin 102 tending to maintain the bearing head 108 in physical contact with the upper margin 64 of the spring seat 62. An optional spring cage vent 120 vents the spring cage 68 to ambient. A spring cage vent orifice 122 of selected flow area may be included to control the venting of the spring cage 68.

The design of the controller 100 of FIG. 2 provides that bearing head 108 of the closing pin 102 is in mechanical contact with the upper margin 64 of the spring seat 62 at all times. The pressure head 110 of the closing pin 102 is exposed to the pressure chamber 116 and therefore to whatever fluid pressure exists in pressure chamber 116. The area of the pressure head 110 is selected to be smaller than the area of the opening surface 56 in combination with the area of tip 61 of the needle valve 50 in order to ensure that the needle valve 50 always stays open under maximum injection pressure. The orifice 114 is disposed between the intensifier plunger chamber 44 and the controller pressure chamber 116. This feed orifice 114 provides fluid communication between the two volumes 44, 116 at all times. Leakages around the closing pin 102 and the bore defined in the injector module 14 in which pin 102 is disposed are preferably kept at a minimum by defining close tolerances therebetween.

The volume of the pressure chamber 116 is carefully chosen to work cooperatively with the flow area of the orifice 114 and the area of the pressure head 110 to provide both stability and quick closing of the needle valve 50. The biasing spring 118 is selected to be a relatively light spring to keep the closing pin 102 seated on the spring seat 62 when pressure in the pressure chamber 116 is relatively low.

Needle valve 50 is a conventional valve such as is described with reference to the prior art injector 10 above. However, the needle valve return spring 52*a* utilized with the controller 100 of the present invention is selected to exert significantly less bias on the needle valve 50 than the conventional needle valve return spring 52 as described above with reference to the prior injector 10. Preferably, the needle valve return spring 52*a* exerts less than half the bias exerted by the conventional needle valve spring 52 of the prior art injector 10.

Preferably the needle spring cage 68 is vented at all times by the spring cage vent 120, although, it is possible also to eliminate the spring cage vent 120 to completely seal the spring cage 68.

Representative preferred characteristics of the controller 100 are as follows. The diameter of the orifice 114 is between about 0.05 mm and 0.30 mm and is most preferably 0.16 mm. The volume of the pressure chamber 116 is between 50 and 150 mm cubed and most preferably 100 mm cubed. The needle valve return spring 52*a* preload is preferably between 40 N and 140 N and is most preferably 70 N. Such preload permits sealing at 22,150 psi cylinder pressure. The diameter of the closing pin 102 is between about 1.5 mm and 4.0 mm and is most preferably 2.5 mm. The clearance between the pin body 106 of the closing pin 102 and the bore defined in the injector module 14 in which the closing pin 102 translates is preferably about 3 $\mu$m. The preferred diameter of the spring cage vent orifice 122 is preferably about 1 mm.

In operation, at the beginning of the injection event, the entire injector is under low fuel pressure. This pressure is about 50 psi as provided by the fuel gallery through the checked fuel refill 46 and is present in the plunger chamber 44, the high pressure fuel passage 48, the kidney 54, at the tip 61, and in the pressure chamber 116. The needle valve 50 is in its closed disposition with the tip 61 sealing off the orifices 60. The needle valve 50 is maintained in the closed disposition by the bias exerted by the needle valve return spring 52. The closing pin 102 is seated on the spring seat 62 under the bias of the biasing spring 118. As noted above, pressure in the pressure chamber 116 is also at about 50 psi.

The injection event is initiated by a command to the solenoid 24 shifting the spool 22 from the venting disposition to the open inlet disposition. As noted above, such shifting opens actuating fluid inlet 26 and floods the actuation chamber 38 with high pressure actuating fluid. Pressure in the plunger chamber 44 builds as the piston 32 and plunger 34 are stroked downward in the compression stroke by the force of the high pressure actuating fluid acting on the piston head 36. The buildup of fuel pressure in the plunger chamber 44 also builds fuel pressure in the high pressure fuel passage 48 and of the kidney 54 (and at tip 61). Due to throttling by the orifice 114, and the proper sized volume of the pressure chamber 116, pressure in the pressure chamber 116 does not build at the same rate and it takes a certain amount of time in order to build pressure in the pressure chamber 116 to equal the pressure in the plunger chamber 44. The high pressure fuel in the kidney 54 acts on the opening surface 56 of the needle valve 50 causing the needle valve 50 to open mainly against the bias (reduced) exerted by the needle valve return spring 52*a* but also against the relatively low pressure existing in the pressure chamber 116. This is referred to as the low VOP feature. As noted above, the needle valve return spring 52*a* exerts a significantly reduced closing bias on the needle valve as compared to the conventional needle valve return spring 52 noted with respect to prior art injector 10 above. Accordingly, the VOP of the needle valve 50 is significantly reduced when employing controller 100 of the present invention.

During the needle valve opening process, pressure in the pressure chamber 116 provides some biased force to resist the opening of the needle valve 50. This can be seen as a damping force since it provides stability during the opening of the needle valve 50. Overall, fuel pressure to the kidney 54 and the orifices 60 builds up faster than pressure in the pressure chamber 116. Fuel injection commences from the orifices 60 when the needle valve 50 shifts upward and the tip 61 exposes the orifices 60.

As the injection event proceeds, the needle valve 50 lifts to its full upward (open) disposition. Fuel injection continues and pressure in the pressure chamber 116 continues to build as high pressure fuel is metered through the orifice 114 into the pressure chamber 116. Since the area of the bearing head 108 of the closing pin 102 is significantly less than the area of the opening surface 56 (and tip 61 surface) of the needle valve 50, the needle valve 50 always stays at the open position even when the pressure in the pressure chamber 116 is at the same level as the pressure in the plunger chamber 44. The uplifting force generated on the opening surface 56 of the needle valve 50 is always greater than the total force in opposition from the closing pin 102 and the needle valve return spring 52*a* during the injection event.

At the end of the injection event, a second command to the solenoid 24 returns the spool 22 to the closed disposition. In such disposition, the spool 22 vents the high pressure actuating fluid in the actuation chamber 38 to ambient via the vent 28. The piston 32 and plunger 34 reverse direction and commence to return to their initial disposition under influence of the intensifier return spring 40. Fuel pressure in the plunger chamber 44, the high pressure fuel passage 48 and the kidney 54 drops immediately. Due to the orifice 114 that controls the ingress and egress of fuel from the pressure chamber 116, pressure inside the pressure chamber 116 does not decay quickly. Significantly, the retained pressure in the pressure chamber 116 acts to assist the needle valve return spring 52*a* in the rapid closing of the needle valve 50. The needle valve 50 closes under the combined force of the pressure in the pressure chamber 116 acting on the closing pin 102 and the needle valve return spring 52*a*. The closing is much quicker than with the conventional prior art design in order to effect a desirable sharper termination of the injection event than is possible with the conventional needle valve closing spring 52. The combination of the biases exerted by the closing pin 102 and the needle valve return spring 52*a* effects a very high valve closing pressure (VCP).

The controller 100 of the present invention then effects needle valve 50 opening at relatively low VOP and further effects needle closing at a very high VCP. This feature provides the engine with very low noise emission and at the same time effectively reduces the emission obnoxious byproducts of combustions due to the sharper termination of the injection event effected by the very high VCP.

Figure 3:
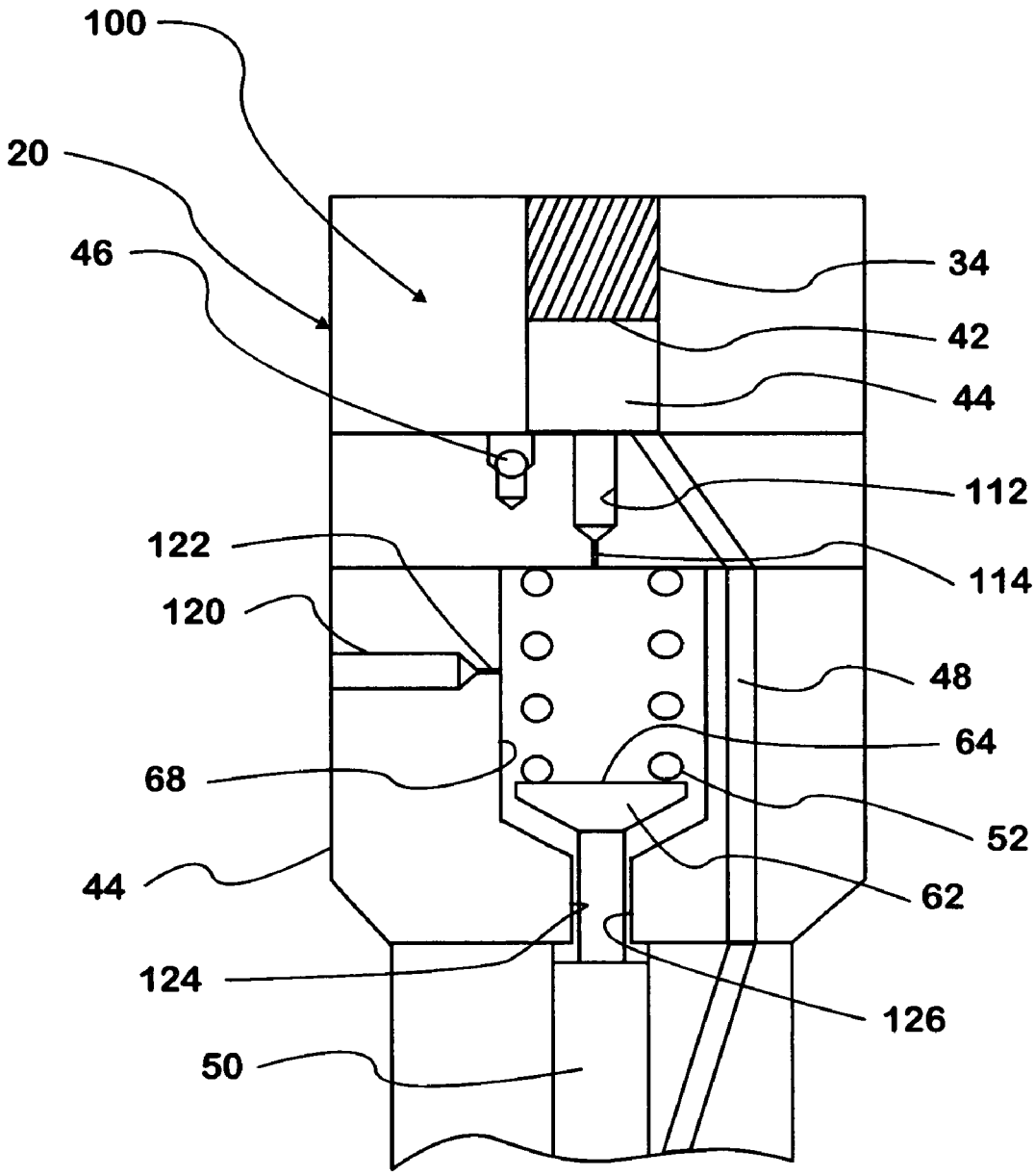
FIG. 3 is a sectional view of a further embodiment of the controller of the present invention having duel orifice damping.

FIG. 3 depicts another embodiment of the controller 100 of the present invention designed for incorporation into the prior art injector 10 with only minimal changes. This embodiment of the controller 100 is primarily to effect damping of the opening motion of the needle valve 50. To effect such damping, an inlet 112 is in fluid communication with the plunger chamber 44. Flow in the inlet 112 is throttled by an orifice 114 that is in fluid communication with the spring cage 68. The spring cage 68 is vented by a spring cage vent 120. Flow through the spring cage vent 120 is throttled by the spring cage vent orifice 122.

In operation, pressure in the spring cage 68 builds at a slower rate than pressure in the plunger chamber 44 and in the high pressure fuel passage 48 when the plunger 34 is stroking downward in the compression stroke. Opening of the needle valve 50 takes place against the combined force exerted by the needle valve return spring 52 and the fuel pressure in the spring cage 68 acting on the upper margin 64 of the spring seat 62. Fuel pressure in the spring cage 68 is controlled by the orifice 114 restricting the in-flow of high pressure fuel in cooperation with the orifice 122 controlling the venting of high pressure fuel from the spring cage 68. Since the opening of the needle valve 50 must act against a certain fluid pressure, opening motion of the needle valve 50 is opposed by needle valve return spring 52 and damped by the action of high pressure fuel residing in the spring cage 68 acting on the spring seat 62.

Figure 4:
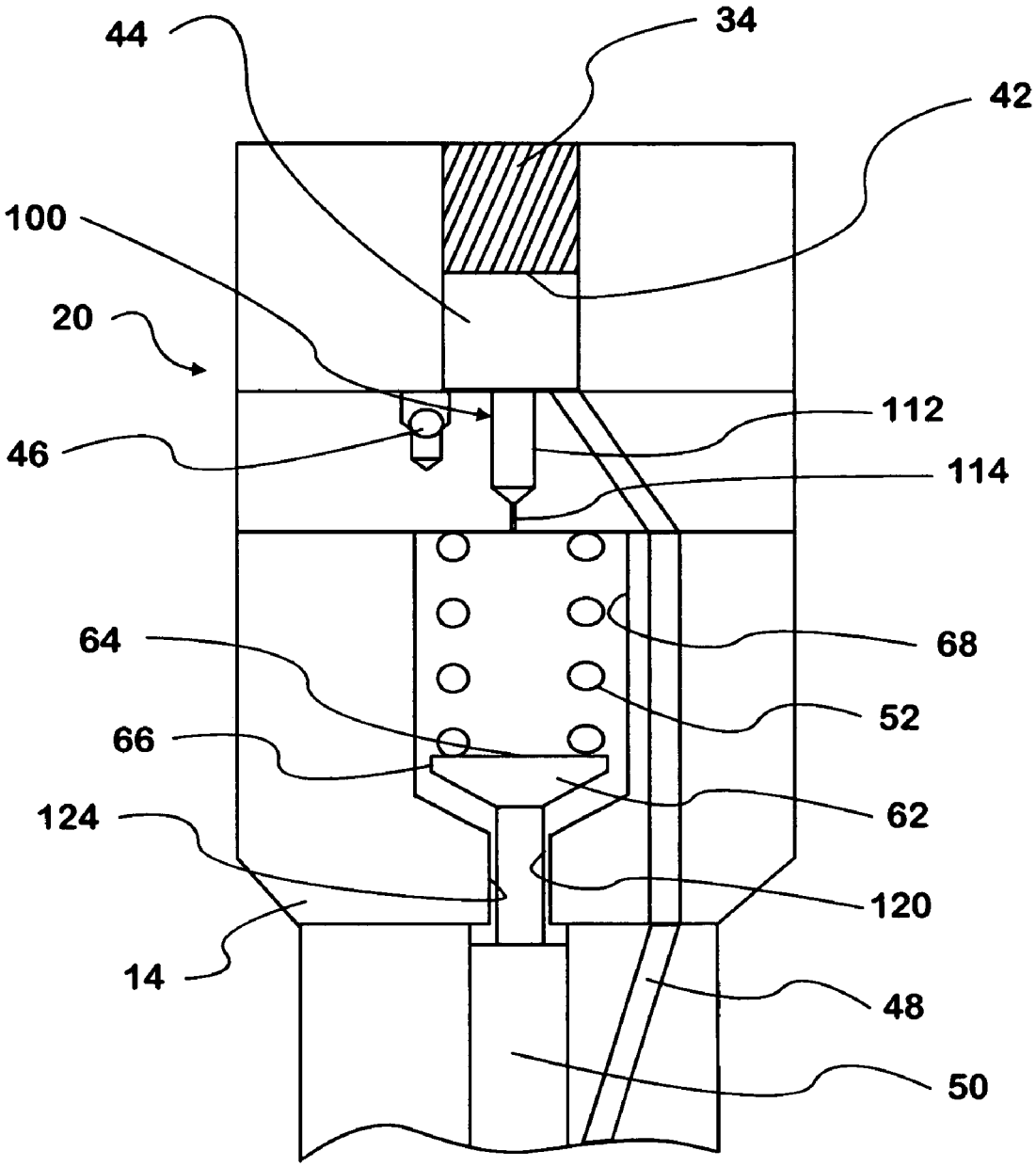
FIG. 4 is a further embodiment of the controller of the present invention having single orifice damping.

FIG. 4 depicts a simpler embodiment of the controller 100 of FIG. 3. In this embodiment, the spring cage 68 is effectively sealed other than any leakage through the leakage passage 124 defined between the spring seat 62 and the guide bore 126 defined in the injector module 14. This leakage may be severely restricted or may permit a certain amount of leakage, as desired, by controlling tolerances of the passage 124. The embodiment of FIG. 4 operates in substantially the same manner as that described with reference to FIG. 3 above. High pressure fuel in the spring cage 68 dampens the upward, opening translation of the needle 50 as the spring seat 62 translates upward, high pressure fuel is forced around the periphery of the shoulder 66 to the volume defined beneath the spring seat 62. Additionally, a certain amount of high pressure fuel escapes from the spring cage 68 through the leakage passage 124.

Figure 5:
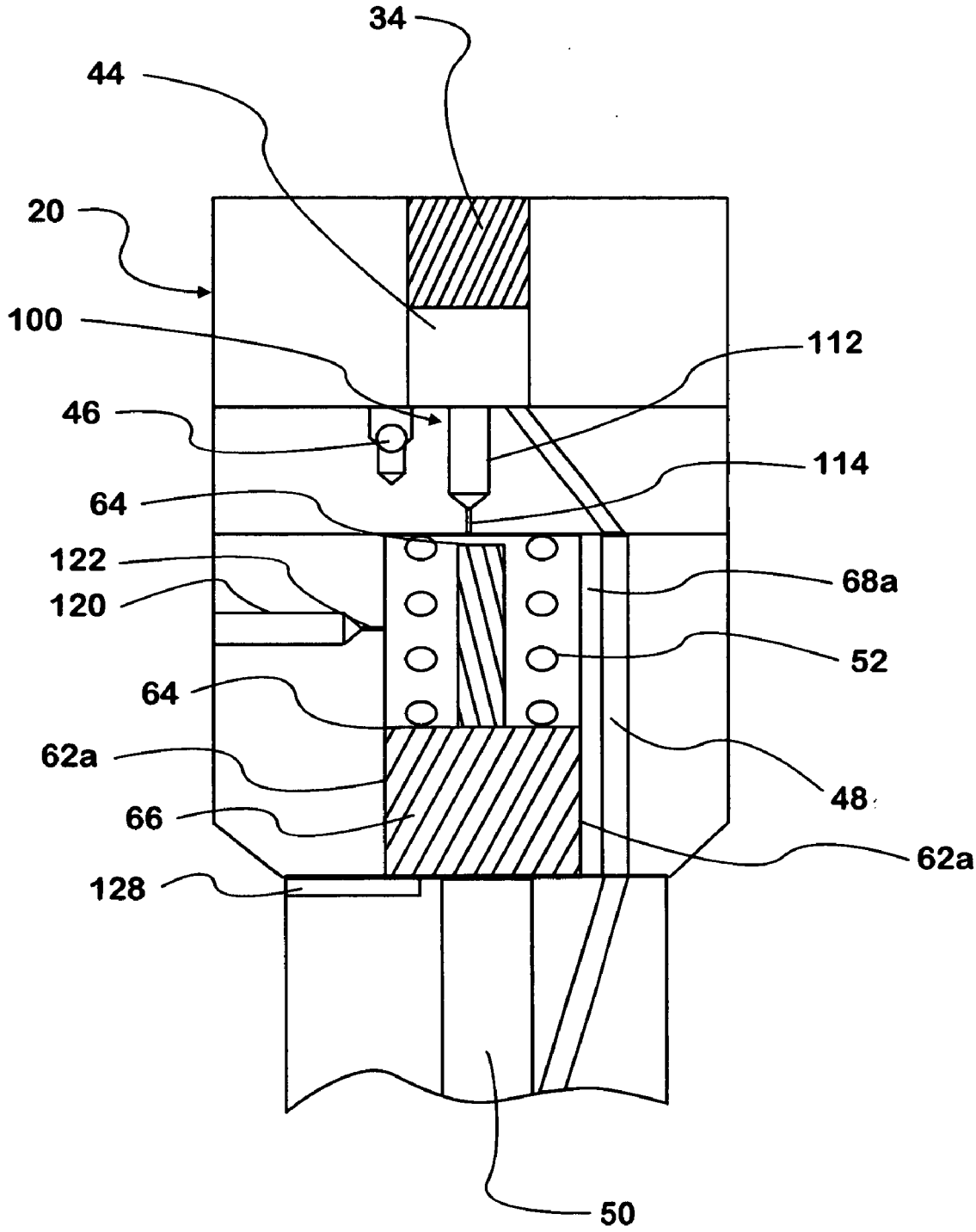
FIG. 5 is a further embodiment of the controller of the present invention having dual orifice damping and a sealed spring cage.

FIG. 5 is a further embodiment of the controller 100 of the present invention, also incorporating dual orifice damping. The embodiment of FIG. 5 requires additional changes with respect to the prior art injector 10. Specifically, the spring cage 68*a* is modified to obtain flexibility on performance tuning. The spring cage 68*a* has two orifices: the inlet orifice 114 and the vent orifice 122. The spring seat 62*a* is also modified, having very tight clearance between the circumferential margin of the spring seat 62*a* and the wall of the spring cage 68*a*. A venting slot 128 is added to vent the spring cage 68*a* during return of the needle valve 50 from the open disposition to closed disposition.

Figure 6:
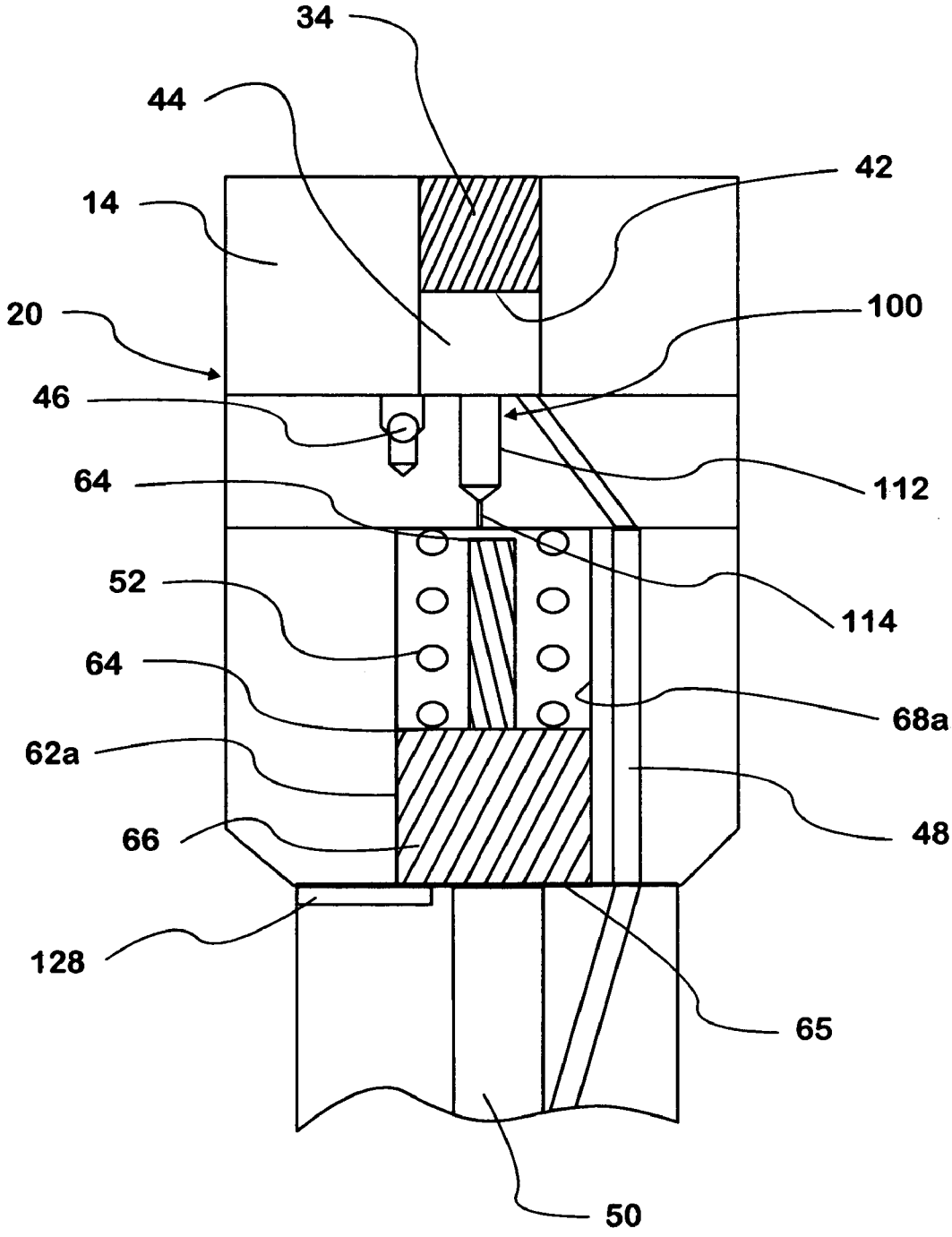
FIG. 6 is a further embodiment of the controller of the present invention having single orifice damping and a sealed spring cage.

The embodiment of FIG. 6 has all the same features as noted above with reference to the embodiment of FIG. 5 except that spring cage vent 120 and spring cage vent orifice 122 are eliminated.

Operation of the embodiments of FIGS. 3 and 5 with dual orifice damping is as noted below. Before an injection event, the spool 22 of the control valve assembly 16 is at its closed position. The actuation fluid in the actuation chamber 38 is vented to atmospheric pressure via the actuating fluid vent 28. Intensifier piston 32 and plunger 34 is at its topmost, retracted disposition. Spring cage 68, 68*a* is in fluid communication with the plunger chamber 44 at the bottom of the plunger 34. The spring cage 68, 68*a* is additionally in fluid communication with the low pressure fuel gallery by means of the checked fuel refill 46 through the inlet orifice 114 and the vent orifice 122. Accordingly, the pressure within the spring cage 68, 68*a* is the same as the pressure in the low pressure fuel gallery (about 50 psi) that is available at the checked fuel refill 46.

When the spool 22 of the control valve assembly 16 is shifted to its open inlet disposition by means of a control signal to the solenoid 24, the intensifier piston 32 and plunger 34 move downward under influence of the high pressure actuating fluid, compressing fuel in the volume defined plunger chamber 44 and the high pressure fuel passage 48. The fuel pressure within this volume builds up quickly causing fuel to flow through inlet orifice 114 from the plunger chamber 44 to the spring cage 68, 68*a*. At the same time, the spring cage vent orifice 122 relieves some of the pressure in the spring cage 68, 68*a*, thereby avoiding excessive pressure buildup in the spring cage 68, 68*a*.

The optimum pressure in the spring cage 68, 68*a* is achieved by adjusting the flow area of the two orifices 114, 122. Both of the orifices 114, 122 are preferably very restrictive. Therefore, there is a considerable amount of pressure drop across the two orifices 114, 122. This results in the pressure level in the spring cage 68, 68*a* being considerably lower than that in the plunger chamber 44 during the compressing stroke of the piston 32 and plunger 34. Additionally, the pressure level in the spring cage 68, 68*a* is considerably lower than the fuel pressure in the kidney 54. Therefore, the fuel pressure in the kidney 54 acts on the opening surface 56 to shift the needle valve 50 upward against the bias exerted by the preload of the needle valve return spring 52 and the pressure force in the spring cage 68, 68*a* acting on the spring seat 62, 62*a* and transmitted to the back of the needle valve 50. However, because of the fuel pressure in the spring cage 68, 68*a*, the opening of the needle valve 50 occurs in a more gradual fashion as compared to the case in which the needle 50 is operating only against the preload of the needle valve return spring 52. This gradual opening of the needle valve 50 is beneficial to the improved control of movement of the needle valve 50.

The improved control of the movement of the needle valve 50 is particularly beneficial for control of the small quantity of fuel that is desired to be injected for a pilot injection operation. During the injection event, the needle valve 50 is at its opened, upward shifted disposition. Depending on the operating conditions, the needle valve 50 could be at full uplift position or partial uplift position, as desired. The partial uplift position of the needle valve 50 restricts the fuel flow through the orifices 60 to advantageously minimize the amount of fuel injected during the pilot injection portion of the injection event.

The pressure in the spring cage 68, 68*a* is always at a lower level than the pressure at the kidney 54 without regard to the duration of the injection event. This is the case because the two orifices 114, 122 together are able to build up pressure in the spring cage 68, 68*a* while preventing the pressure in the spring cage 68, 68*a* from approaching the level of the pressure in the kidney 54.

When the spool 22 of the control valve assembly 16 is shifted from the open inlet disposition to the closed venting disposition, the spool 22 shuts off the inward flow of actuating fluid at the actuation fluid inlet 26 and vents the actuating fluid from the actuating fluid vent 28. The actuation fluid pressure in the actuation chamber 38 drops dramatically and the piston 32 and plunger 34 commence a return translation upwards toward the top most disposition under the influence of the bias exerted by the intensifier return spring 40. This causes the pressure in the plunger chamber 44 in the kidney 54 to drop dramatically. The pressure in the spring cage 68, 68*a* also starts to decay but at a much slower rate due to the throttling effect of the small sizes of the orifices 114, 122. The needle valve 50 therefore will start to close if the pressure at the kidney 54 and tip 61, which tends to keep the needle valve at the open disposition, falls below the sum of the pressure force in the spring cage 68, 68*a* acting on the back of the needle valve 50 and the needle valve return spring 52. It is the pressure in the spring cage 68, 68*a* in combination with the bias of the needle valve return spring 52 which tends to close the needle valve 50. Because of the pressure in the spring cage 68, 68*a*, the needle valve is able to close at a higher fuel pressure (VCP) than is the case without any pressure in the spring cage 68, 68*a*. This feature allows the injector 10 incorporating controller 100 to produce a sharper end of injection, which is beneficial to suit emission reduction. Additionally, if the needle valve 50 closes at higher VCP, there is no chance for the high pressure gas in the combustion cylinder of the engine to blow back into the injector 10 during the closing of the needle valve 50.

During the entire injection event, the spring cage 68, 68*a* is charged with positive pressure. The positive pressure in the spring cage 68, 68*a* acts to eliminate the cavitation in the spring cage 68, 68*a*. Such cavitation in the past has been a significant durability concern.

Additionally, for pilot injection operation, since the needle valve 50 closes at a relatively high fuel pressure at the end of the pilot portion of the injection event, the fuel pressure in the high pressure line 48 remains relatively high. Before the main injection portion of the injection event, there is therefore less chance for the pressure in the high pressure fuel passage 48 to decay below the vapor pressure of the fuel. Beneficially, this reduces the chance of cavitation in the high pressure fuel passage 48 between the pilot portion of the injection event and the main portion of the injection event.

It should be noted that the embodiments of FIGS. 4 and 6 have only the inlet orifice 114. The operation of the controller 100 is basically the same as described above with reference to the embodiments of FIGS. 3 and 5. An advantage of the embodiments of FIGS. 4 and 6 is a simplified design and manufacturing process when modifying the prior art injector 10 to incorporate the controller 100 of the present invention.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A controller for controlling a needle valve of a spring closing type fuel injector, comprising:

a fluid assist selectively exerting a force on the needle valve, the force acting in cooperation with a bias exerted by a return spring on the needle valve to effect a relatively low valve opening pressure of the needle valve and relatively very high valve closing pressure, said fluid assist being generated by a fluid under pressure acting on a pressure head surface having an area that is less than a needle valve opening surface, the needle valve opening surface being selectively communication with pressurized fuel.

2. The controller of claim 1, the pressurized fuel generating a force on the needle valve opening surface in opposition to a force generated by the fluid under pressure acting on the pressure head surface.

3. The controller of claim 2, the pressure head surface being translatably disposed in a pressure chamber, the pressure chamber being in fluid communication with a source of high pressure fluid.

4. The controller of claim 3, the fluid communication with the source of high pressure fluid being effected via an orifice having a certain size.

5. The controller of claim 4, the area of the orifice and the volume of the pressure chamber being cooperatively selected such that pressure in the pressure chamber builds at a lesser rate than pressure in a plunger chamber after initiation of an injection event.

6. The controller of claim 4, the area of the orifice and the volume of the pressure chamber being cooperatively selected such that pressure in the pressure chamber decays at a lesser rate than pressure in a plunger chamber after termination of an injection event.

7. The controller of claim 1, fluid in a pressure chamber acting to dampen opening translational motion of the needle valve.

8. The controller of claim 1, fluid in a pressure chamber acting to effect in part a rapid closing translational motion of the needle valve.

9. The controller of claim 1 including a closing pin, the closing pin being translatable and having a bearing head being operably coupled to the needle valve and an opposed pressure head being acted on by the force exerted on the needle valve.

10. The controller of claim 9 including a biasing spring, the basing spring acting on the bearing head to cause the bearing head to be operably coupled to the needle valve.

11. A spring closing type fuel injector, comprising:

a controller for controlling a needle valve having a fluid assist selectively exerting a force on the needle valve, the force acting in cooperation with a bias exerted by a return spring on the needle valve to effect a relatively low valve opening pressure of the needle valve and relatively very high valve closing pressure, the fluid assist being generated by a fluid under pressure acting on a pressure head surface having an area that is that is less than a needle valve opening surface, the needle valve opening surface being selectively in communication with pressurized fuel.

12. The fuel injector of claim 11, the pressurized fuel generating a force on the needle valve opening surface in opposition to a force generated by the fluid under pressure acting on the pressure head surface.

13. The fuel injector of claim 12, the pressure head surface being translatably disposed in a pressure chamber, the pressure chamber being in fluid communication wit a source of high pressure fluid.

14. The fuel injector of claim 13, the fluid communication with the source of high pressure fluid being effected via an orifice having a certain size.

15. The fuel injector of claim 14, the area of the orifice and the volume of the pressure chamber being cooperatively selected such that pressure in the pressure chamber builds at a lesser rate than pressure in a plunger chamber after initiation of an injection event.

16. The fuel injector of claim 14, the area of the orifice and the volume of the pressure chamber being cooperatively selected such that pressure in the pressure chamber decays at a lesser rate than pressure in a plunger chamber after termination of an injection event.

17. The fuel injector of claim 11, fluid in a pressure chamber acting to dampen opening translational motion of the needle valve.

18. The fuel injector of claim 11, fluid in a pressure chamber acting to effect in part a rapid closing translational motion of the needle valve.

19. The fuel injector of claim 11 including a closing pin, the closing pin being translatable and having a bearing bead being operably coupled to the needle valve and an opposed pressure head being acted on the force exerted on the needle valve.

20. The fuel injector of claim 19 including a biasing spring, the basing spring acting on the bearing head to cause the bearing head to be operably coupled to the needle valve.

21. A method for controlling a needle valve of a spring closing type fuel injector, comprising:

selectively exerting a force on the needle valve by means of a fluid assist, the force acting in cooperation wit a bias exerted by a return spring on the needle valve to effect a relatively low valve opening pressure of the needle valve and relatively very high valve closing pressure, and generating the fluid assist by a fluid under pressure acting on a pressure head surface having an area that is that is less than a needle valve opening surface, the needle valve opening surface being selectively in communication with pressurized fuel.

22. The method of claim 21, including generating the force by means of pressurized fuel acting on the needle valve opening surface in opposition to a force generated by the fluid under pressure acting on the pressure head surface.

23. The method of claim 22, including translatably disposing the pressure head surface in a pressure chamber, the pressure chamber being in fluid communication with a source of high pressure fluid.

24. The method of claim 23, including effecting the fluid communication with the source of high pressure fluid via an orifice having a certain size.

25. The method of claim 24, including cooperatively selecting the area of the orifice and the volume of the pressure chamber such that pressure in the pressure chamber builds at a lesser rate than pressure in a plunger chamber after initiation of an injection event.

26. The method of claim 24, including cooperatively selecting the area of the orifice and the volume of the pressure chamber such that pressure in the pressure chamber decays at a lesser rate than pressure in a plunger chamber after termination of an injection event.

27. The method of claim 21, including dampening opening translational motion of the needle valve by means of a fluid in a pressure chamber.

28. The method of claim 21, including effecting in part a rapid closing translational motion of the needle valve by means of a fluid in a pressure chamber.

29. The method of claim 21 including translatably disposing a closing pin in a connector, operably coupling a closing pin being bearing head being to the needle valve and acting on an opposed pressure head being by the force exerted on the needle valve.

30. The method of claim 29 including acting on the bearing head to cause the bearing head to be operably coupled to the needle valve by means of a biasing spring.

* * * * *